US007396112B2

(12) United States Patent
Sanada

(10) Patent No.: US 7,396,112 B2
(45) Date of Patent: Jul. 8, 2008

(54) INKJET RECORDING HEAD AND INKJET RECORDING APPARATUS

(75) Inventor: Kazuo Sanada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 385 days.

(21) Appl. No.: 11/086,576

(22) Filed: Mar. 23, 2005

(65) Prior Publication Data

US 2005/0212862 A1 Sep. 29, 2005

(30) Foreign Application Priority Data

Mar. 24, 2004 (JP) ..... 2004-087806

(51) Int. Cl.
*B41J 2/045* (2006.01)
*B41J 2/165* (2006.01)

(52) U.S. Cl. ..... 347/68; 347/22

(58) Field of Classification Search ..... 347/22, 347/29, 32, 33, 35, 68–72
See application file for complete search history.

(56) References Cited

U.S. PATENT DOCUMENTS 6,485,275 B1 * 11/2002 Takeuchi et al. ..... 417/413.2

FOREIGN PATENT DOCUMENTS

JP 08-224892 * 9/1996
JP 08-224892 A 9/1996
JP 9-150509 A 6/1997
JP 9-193379 A 7/1997
JP 2000-015003 A 1/2000
JP 2000-177126 A 6/2000
JP 2003-145782 A 5/2003

* cited by examiner

*Primary Examiner*—Stephen D. Meier
*Assistant Examiner*—Geoffrey Mruk
(74) *Attorney, Agent, or Firm*—Birch, Stewart, Kolasch & Birch, LLP

(57) ABSTRACT

The inkjet recording head comprises: a first vibrating plate which forms part of a pressure chamber connecting an ink supply port and an ink ejection port; a first actuator which induces ink ejection from the ink ejection port for printing by deforming the first vibrating plate; a second vibrating plate which forms part of the pressure chamber; and a second actuator which induces ink ejection from the ink ejection port for performing maintenance by deforming the second vibrating plate, wherein a relationship $K_1>K_2$ is established between a ratio $K_1$ of a volume of ink expelled by deformation of the first vibrating plate in relation to a pressure applied to the first vibrating plate by the first actuator during the ink ejection for printing, and a ratio $K_2$ of a volume of ink expelled by deformation of the second vibrating plate in relation to a pressure applied to the second vibrating plate by the second actuator during the ink ejection for maintenance.

10 Claims, 6 Drawing Sheets

INKJET RECORDING HEAD AND INKJET RECORDING APPARATUS

BACKGROUND OF THE INVENTION

1. Field of the Invention

The present invention relates to an inkjet recording head and an inkjet recording apparatus, and more particularly to an inkjet recording head and an inkjet recording apparatus wherein maintenance can be performed by reliably removing ink that has thickened due to drying, ink with air bubbles mixed in, or other such ink that causes nozzle clogging or ejection problems from the nozzle.

2. Description of the Related Art

Conventionally, one known example of an image recording apparatus is an inkjet recording apparatus (inkjet printer) that has an inkjet head (ink discharge head) with an alignment of multiple nozzles, and that forms an image on a recording medium by discharging ink from the nozzles while moving the inkjet recording head and the recording medium relatively to each other.

Various methods for discharging ink in inkjet printers are conventionally known. One known example is a piezoelectric system, wherein changes the volume of a pressure chamber (ink chamber) by deforming a vibration plate that constitute part of the pressure chamber due to the deformation of a piezoelectric element (piezoelectric ceramic) so that controls the ink supply and the ink discharge to the pressure chamber.

In an inkjet recording apparatus, ink is supplied from an ink tank for storing ink to an ink ejection head via an ink supply channel, and the ink is ejected onto a recording medium from the nozzle of the ink ejection head. The ink used herein is preferably dried and adhered immediately upon being ejected onto the recording medium.

Ink is always filled in the nozzle of the ink ejection head so that printing can be immediately executed when a command for printing is received, and since ink ejection from the nozzle would be unstable if the ink in this nozzle dries, the ink ejection head is sealed by a cap during non-operation to ensure that the ink in the nozzle does not dry.

However, since the ink in the nozzle is exposed to air during printing, the ink dries in a nozzle that does not undergo ejection for a long period of time, and it is possible that the viscosity of the ink will increase, the nozzle will be clogged, and the nozzle will run out of ink, making ejection impossible. Therefore, purging must be performed wherein ink is forcefully ejected from the nozzle at specific intervals.

Also, ink cannot be ejected from the nozzle if air bubbles mixed in the ink supply channel accumulate in the ink ejection head or in front of the filter for removing impurities disposed in the ink supply channel and the supply of ink is blocked by these accumulated air bubbles.

In view of this, various proposals have been made in conventional practice for dealing with ink ejection failures or ejection problems due to inconstant pressure in an inkjet recording apparatus, which is the result of the thickening of ink or adhesion of insoluble components near the nozzle due to a reduction in volatile components in such ink, or of pressure loss due to air bubbles accumulated in the ink flow channel. These proposals include restoring the nozzle by suctioning from the nozzle surface side by negative pressure, applying great positive pressure from the supply side to eject (purge) thickened ink, and the like.

One known example of a measure for dealing with firm clogs in the head is to perform purging with the use of a pump or an ejection actuator, wherein an electric signal with a frequency approximate to the characteristic vibration frequency of the pressure chamber is sent to an ejection actuator to cause resonant vibration in the pressure chamber, resonant vibration is caused intermittently and repeatedly in the filled ink, and air bubbles adhering to the walls of the pressure chamber are extracted and suctioned and removed along with impurities (for example, see Japanese Patent Application Publication No. 2000-177126).

Also, the following are known structural examples for implementing measures for dealing with firm clogs in the head using a device other than a purging pump or an ejection actuator.

In one known example, an ultrasonic transducer is provided next to a common liquid chamber or an individual flow channel in the inkjet head, and ultrasonic vibration is caused in the cleaning fluid of the common liquid chamber or the individual flow channel (for example, see Japanese Patent Application Publication No. 2003-145782).

In another known example, compressed air is fed into the ink ejection channel where the clog has formed, and the ink causing the clog is expelled from the ink ejection port (for example, see Japanese Patent Application Publication No. 9-150509).

In yet another known example, after the ink chamber is formed during the manufacture of the inkjet head, purified water or a cleaning solution is supplied into the ink chamber, and cuttings and other such impurities that formed during manufacturing and adhered to the actuator are expelled from the nozzle along with the purified water or the cleaning solution (for example, see Japanese Patent Application Publication No. 9-193379).

However, the methods proposed in conventional practice have had problems in that air bubbles, impurities, thickened ink, or the like in a channel reaching from an individual flow channels to a nozzle via a pressure chamber are removed by negative or positive pressure from a location separate from any pressure chamber (ink chamber), a long flow channel extends from the pressure source to the point of application, and due to the inertia of the ink therein, an impact force cannot be applied to the location of the problem, a great number of trials are needed until the air bubbles, impurities, thickened ink, or the like are effectively removed, and the ink develops defects.

Also, the example disclosed in Japanese Patent Application Publication No. 2000-177126 has problems in that air bubbles and the like are expelled by inducing the maximum possible vibration using an ejection actuator, but the effects are limited and it is unlikely that the clogging will be sufficiently dispersed because the ejection actuator is optimized for the original ejection and an extra force cannot be produced.

Also, the example disclosed in Japanese Patent Application Publication No. 2003-145782 has problems in that costs increase in the case of a head having multiple nozzles when an ultrasonic element is to be installed in each individual nozzle.

Furthermore, the examples disclosed in Japanese Patent Application Publication Nos. 9-150509 and 9-193379 have problems in that they are designed to clean the ink chamber but are not designed to resume printing by immediately dispersing clogs when the nozzle is clogged during printing, and the restoring operation cannot be performed in real time.

SUMMARY OF THE INVENTION

The present invention has been contrived in view of such circumstances, and an object thereof is to provide an inkjet recording head and an inkjet recording apparatus wherein thickened portions of ink in the head can be removed, air bubbles can be effectively expelled, regular ejection can be restored in a short time with a small amount of ink, and the restoring operation can be performed in near real time.

In order to attain the aforementioned object, the present invention is directed to an inkjet recording head, comprising: a first vibrating plate which forms part of a pressure chamber connecting an ink supply port and an ink ejection port; a first actuator which induces ink ejection from the ink ejection port for printing by deforming the first vibrating plate; a second vibrating plate which forms part of the pressure chamber; and a second actuator which induces ink ejection from the ink ejection port for performing maintenance by deforming the second vibrating plate, wherein a relationship $K_1>K_2$ is established between a ratio $K_1$ of a volume of ink expelled by deformation of the first vibrating plate in relation to a pressure applied to the first vibrating plate by the first actuator during the ink ejection for printing, and a ratio $K_2$ of a volume of ink expelled by deformation of the second vibrating plate in relation to a pressure applied to the second vibrating plate by the second actuator during the ink ejection for maintenance.

Thus, since a second vibrating plate for inducing ejection for maintenance separately from regular ejection and a second actuator for deforming the second vibrating plate are provided, thickened ink and ink with air bubbles mixed in can be reliably removed, and the second vibrating plate is configured so as to be deformed by a greater pressure than the first vibrating plate for regular ejection (by having greater rigidity, for example), whereby purging can be performed with greater impact during maintenance than during regular ejection without affecting regular ejection, and a more reliable restoring operation is made possible.

When a plurality of pressure chambers are provided to the inkjet recording head, a plurality of second actuators which deform a plurality of second vibrating plates provided to the plurality of pressure chambers are driven by a single actuator drive source. The configuration of the apparatus can thereby be simplified, and costs can be reduced.

Preferably, the second actuator has a separate structure from the second vibrating plate; and the second actuator is capable of being retracted from the second vibrating plate when the second actuator is not being driven.

Preferably, the second vibrating plate is disposed near the ink supply port. Thus, air bubbles, impurities, and the like in the pressure chamber between the supply port and the ejection port (nozzle) can be expelled all at once from the nozzle side, and the degree of freedom with the configuration of the apparatus can be increased due to the separate structure of the second actuator for deforming the second vibrating plate.

In order to attain the aforementioned object, the present invention is also directed to an inkjet recording apparatus, comprising the inkjet recording head as described above.

According to the inkjet recording head and inkjet recording apparatus relating to the present invention, thickened portions can be effectively removed and air bubbles expelled in a short time with a small amount of ink by applying a greater impact than can be produced during regular ejection in the pressure chamber, and the restoring operation can be reliably performed by returning to regular ejection.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
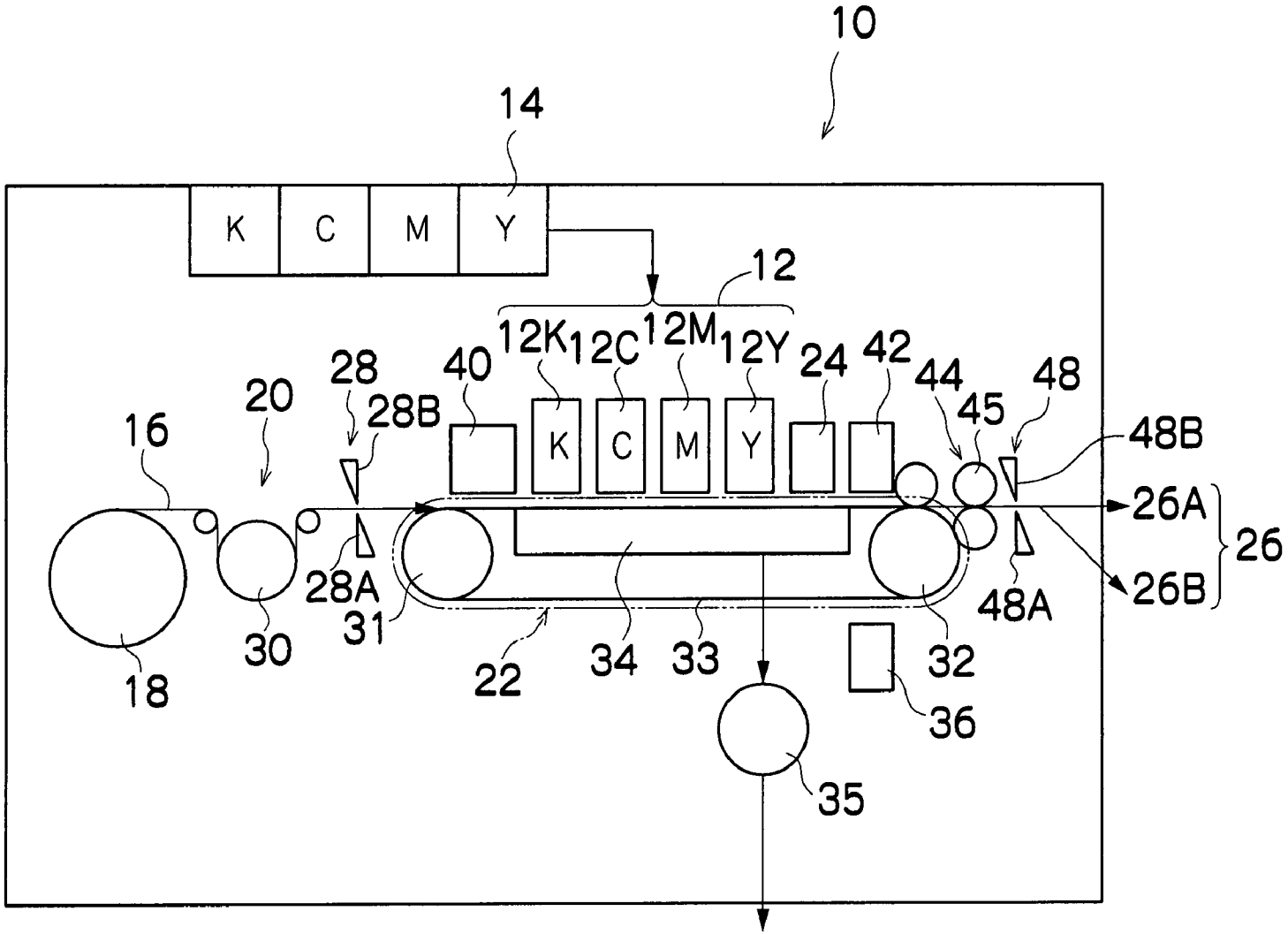
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction. The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction), which is substantially perpendicular to a width direction of the recording paper 16. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10.

The print heads 12K, 12C, 12M, and 12Y are arranged in this order from the upstream side (the left-hand side in FIG. 1) along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator, or the like) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 2:
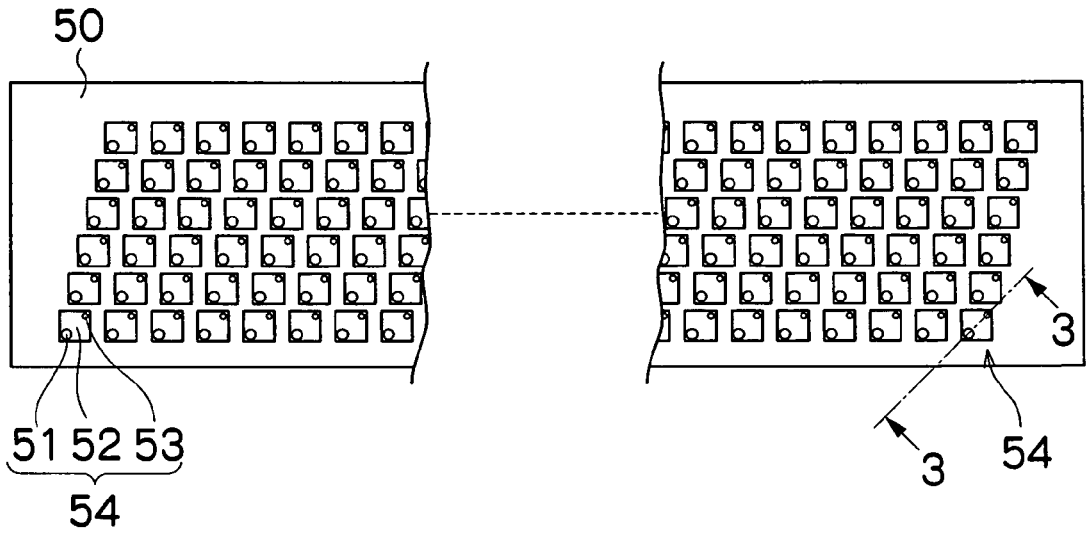
FIG. 2 is a schematic plan view showing an example of a configuration of a print head.

FIG. 2 is a perspective plan view showing an example of the configuration of the print head 50. As shown in FIG. 2, the print head 50 of the present embodiment has two-dimensionally aligned pressure chamber units 54, which are each configured including a nozzle 51 for ejecting ink, a pressure chamber 52 for applying pressure to the ink when the ink is ejected, and a supply port 53 for supplying ink to the pressure chamber 52 from an common flow channel (not shown). This configuration makes it possible to increase the density of nozzles 51.

As shown in FIG. 2, each pressure chamber 52 has a roughly square shape as seen from above, wherein a nozzle 51 is formed in one corner, and an ink supply port 53 is provided at the end of the opposite corner.

Figure 3:
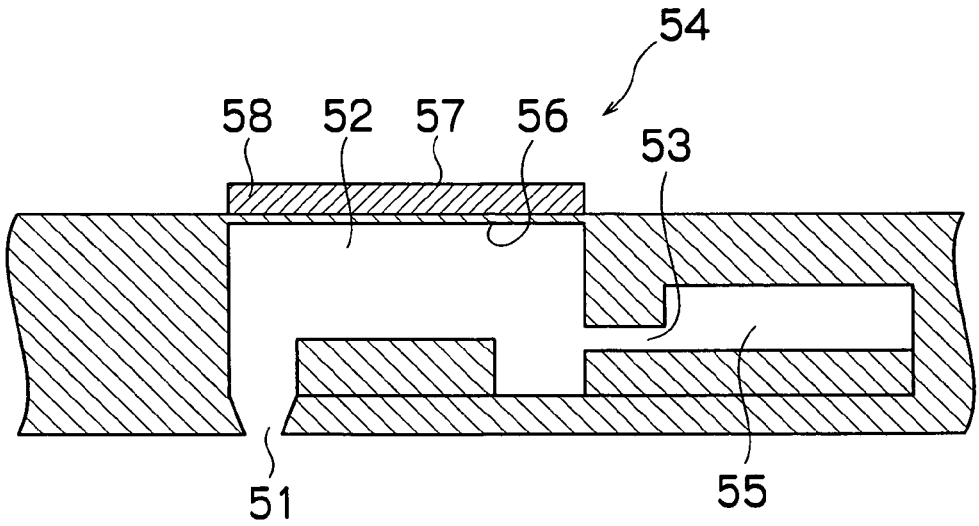
FIG. 3 is a cross-sectional view along a line 3-3 in FIG. 2.

Also, a cross-sectional view of a single pressure chamber unit 54 cut along the dashed line 3-3 in FIG. 2 is shown in FIG. 3.

As shown in FIG. 3, the pressure chamber unit 54 is formed by a pressure chamber 52 in which a nozzle 51 for ejecting ink is formed, a common flow channel 55 for supplying ink via a supply port 53 is communicated with the pressure chamber 52, and one surface (the top surface in FIG. 3) of the pressure chamber 52 is configured from a vibrating plate (first vibrating plate) 56 for regular ejection, to the top of which is bonded a piezoelectric element (first actuator) 58 provided with an individual electrode 57.

Applying a drive voltage to the individual electrode 57 deforms the piezoelectric element 58 and bends the first vibrating plate 56, the capacity of the pressure chamber 52 is reduced, and ink is ejected from the nozzle 51. When the ink is ejected, the piezoelectric element 58 returns to its original state, the original capacity of the pressure chamber 52 is restored, and new ink is supplied from the common flow channel 55 to the pressure chamber 52 through the supply port 53.

FIG. 3 shows only the section pertaining to normal ink ejection, and the second vibrating plate and second actuator for maintenance, which are the main points of the present embodiment, are omitted. These are described next in FIG. 4.

Figure 4:
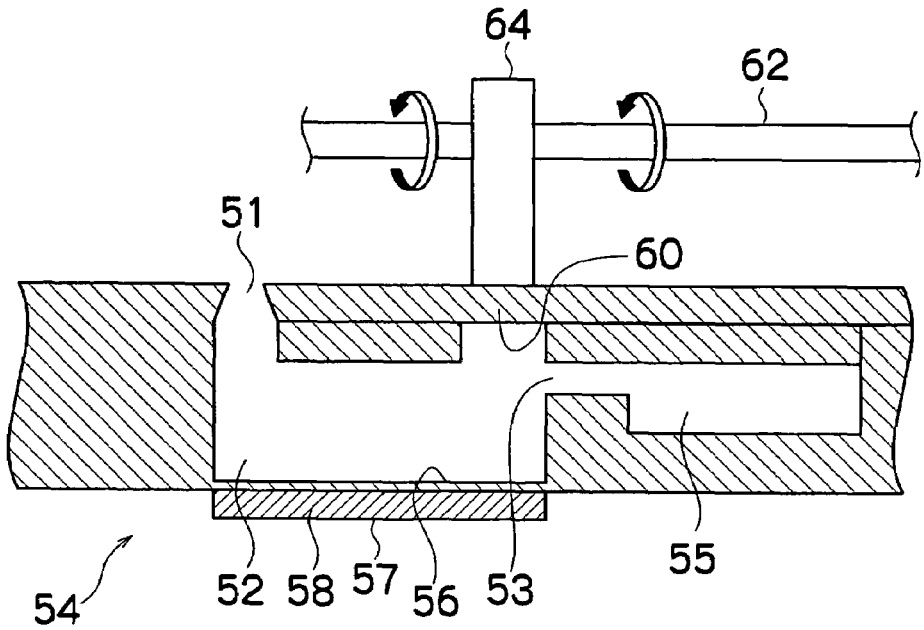
FIG. 4 is a cross-sectional view showing the schematics of the pressure chamber unit of the present embodiment.

FIG. 4 shows the pressure chamber unit 54 and displays the second vibrating plate and second actuator for ejecting (purging) during maintenance relating to the present embodiment. FIG. 4 is a vertical inversion of FIG. 3, but the sections pertaining to regular ejection are the same as in FIG. 3.

As shown in FIG. 4, a second vibrating plate 60 is formed near the ink supply port 53 on the surface opposite the side of the pressure chamber 52 on which the first vibrating plate 56 is formed. Also, an eccentric cam 64 that rotates around a rotating shaft 62 that is rotatably driven by an motor (not shown) is provided to the outer side of the second vibrating plate 60 (the side opposite the pressure chamber 52) as a second actuator for applying pressure (impact force) to the second vibrating plate 60 during ejection for maintenance.

Figure 5:
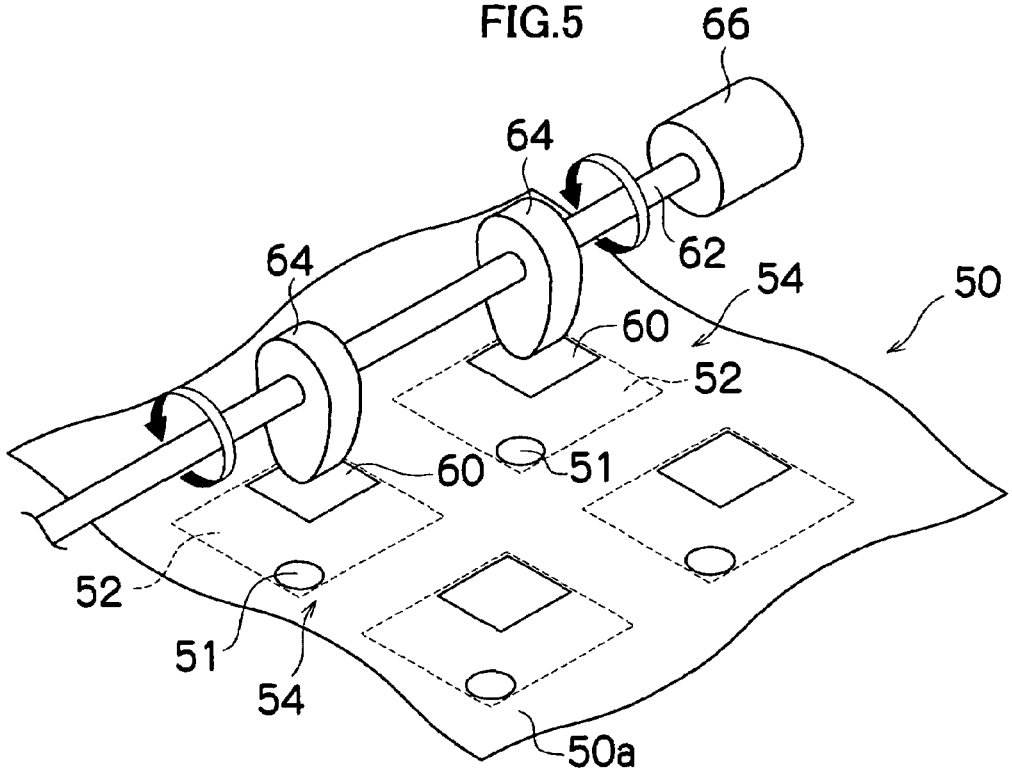
FIG. 5 is a perspective view showing the schematics of the print head of the present embodiment.

Also, FIG. 5 shows a perspective view of a print head (inkjet recording head) 50 configured from a matrix arrangement of pressure chamber units 54 provided with such a second vibrating plate 60 and a second actuator (eccentric cam 64) in each pressure chamber 52.

As shown in FIG. 5, each eccentric cam 64 as a second actuator for applying pressure to deform the second vibrating plate 60 provided near the ink supply port 53 (omitted in FIG. 5) of the pressure chamber 52 is set at a position on the rotating shaft 62 rotatably driven by the motor 66 that corresponds to each second vibrating plate 60.

As the rotating shaft 62 is rotatably driven by the motor 66, the eccentric cams 64 set and fixed in place on the rotating shaft 62 also rotate, and the distal end portions of the eccentric cams 64 longitudinally farther away from the rotating shaft 62 strike the second vibrating plates 60 to create impact in the pressure chambers 52, whereby thickened ink or ink containing air bubbles in the pressure chambers 52 is ejected (purged) from the nozzles 51.

Also, the eccentric cams 64 as second actuators (impact-transmitting members) for striking the second vibrating plates 60 do not need to be set for the second vibrating plates 60 of all the pressure chambers 52, and a plurality of eccentric cams 64 may be affixed to one rotating shaft 62 so as to correspond to one line or one row of pressure chambers 52 aligned in a two-dimensional matrix configuration, as shown in FIG. 5, for example. In this case, the rotating shaft 62 can be moved parallel to the nozzle surface 50*a* along with the motor 66, or, conversely, the second vibrating plates 60 in all the pressure chambers 52 can be struck by moving the print head 50.

Thus, since affixing a plurality of eccentric cams 64 to one rotating shaft 62 results in the second actuators for striking the second vibrating plates 60 being disposed across the plurality of pressure chambers 52, there is no need to separately create an eccentric cam 64 for each of the pressure chambers 52, and the costs of the apparatus can be reduced. Also, the restoring operation can be performed in near real time in the present embodiment.

Also, the timing by which the eccentric cams 64 strike the second vibrating plates 60 when ink is discharged from the plurality of pressure chambers 52 during maintenance may either be simultaneous or have a time difference. With a time difference, the eccentric cams 64 affixed to the rotating shaft 62 should be affixed at positions that are misaligned at slight angles.

Also, it is vital that the second vibrating plates 60 for performing purging in this manner during maintenance do not create a pressure loss during regular ejection because ejection is affected when the piezoelectric elements 58 as first actuators deform the first vibrating plates 56 during ejection for normal printing, if the pressure applied in the pressure chambers 52 is absorbed by the deformation of the second vibrating plates 60, creating a pressure loss.

Also, since a greater impact force is applied to the second vibrating plates 60 during purging than during regular ejection, the second vibrating plates 60 for maintenance preferably have a higher rigidity than the first vibrating plates 56 for regular ejection.

More specifically, a metal such as stainless steal may be used for the second vibrating plates 60, and the plate may be made thicker and more rigid, for example, or a configuration may be used in which contact is maintained in a state in which a preload is applied to eccentric cams 64 made of stainless steal and treated with abrasion-resistant polytetrafluoroethylene. In particular, a resin or another such elastic member may be used in the eccentric cams 64 in order to intentionally lessen the impact.

Thus, the impact-transmitting members configured from the second vibrating plates 60 and the second actuators (eccentric cams 64) are designed so that cam-shaped protuberances (longitudinally distal ends of the eccentric cams 64) collide with the highly rigid second vibrating plates 60 to apply impact. The extent of this impact can be described as follows, for example.

If the rotational frequency is 120 Hz, the generated force is 2 N, and the weight is 0.85 g, as with a commercial eccentric vibrating motor, for example, then the impact is found to be 3 m/s at 120 Hz by a simple calculation.

At this time, assuming that 1 mL of ink is about 1 g, the momentum as the purging capacity is 1 g×3 m/s, and the momentum of droplets ejected by one nozzle is 1 pl×10 m/s, or 1 ng×10 m/s. Therefore, it is possible to achieve an impact force of $3\times10^7$ times that of discharge. Consequently, if 100 nozzles are driven simultaneously, then the momentum allowed is about $3\times10^5$ times of the discharge of one nozzle, which is considered to be sufficient for the impact force.

Also, the expelled volume at this time has a maximum of ⅓ mL for all the nozzles, and the expelled volume for one nozzle has a maximum of 1/300 g (about $3\times10^6$ pL).

Figure 6:
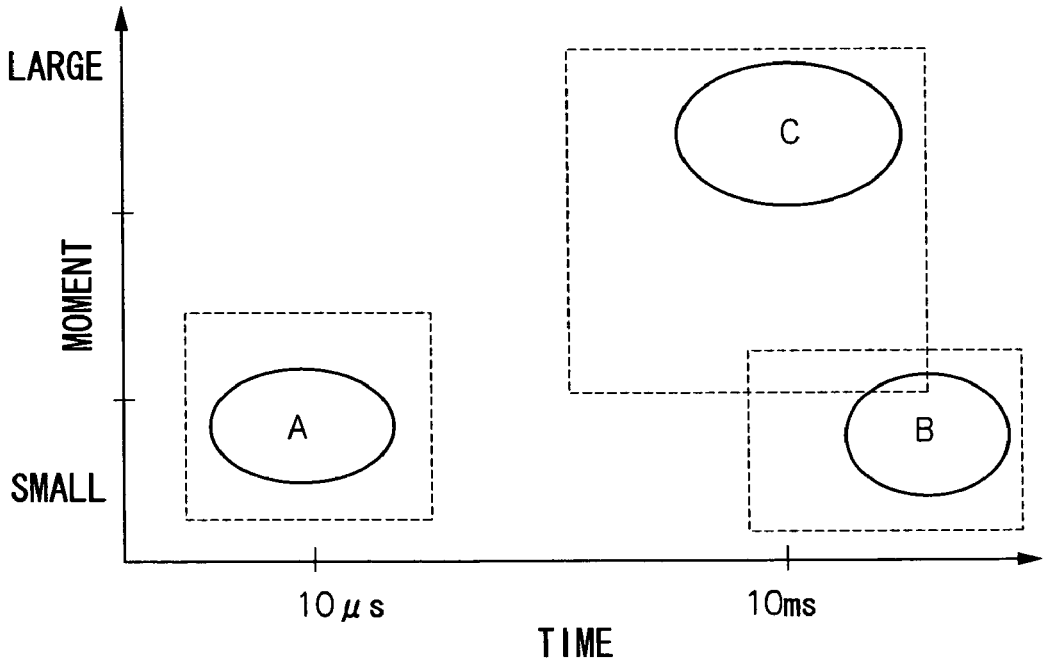
FIG. 6 is an explanatory diagram showing the relationship between the operating time and the moment during discharge.

The impact force described above is shown in FIG. 6 as a relationship between moment and time. In FIG. 6, the time along the horizontal axis is the time when the discharge operation is performed using an actuator, and the moment along the vertical axis corresponds to the momentum (impulse). In FIG. 6, the A area indicates purging with a conventional actuator, and the B area indicates purging with a suction pump. Thus, the operating time with a conventional actuator is short, but the allowable moment is small. Also, the pump has a small moment and a long operating time.

By contrast, the C area indicates the present embodiment. Hence, the impact-transmitting member of the present embodiment can allow a greater moment (impact force) to be generated than in conventional practice, a greater impact that cannot be achieved with a piezoelectric element for conventional discharge can be produced with a reasonable expelled volume, and more efficient expulsion is made possible.

The calculation described above is an approximate value for the maximum capacity of the eccentric motor, and it is possible to design a reduction in the expelled amount for one nozzle by adding a buffer material. Also, 0.5 mL/time is merely an example of conventional capacity maintained using an external pump, but it is possible to adjust this amount downward by using a motor.

Thus, the second vibrating plates 60 of the present embodiment are designed so that the ratio between pressure and expelled volume as determined by the size $l_2$, plate thickness $t_2$, and Young's modulus $Y_2$ of the second vibrating plates 60 (ratio of expelled volume per unit of pressure) $K_2=f(l_2, t_2, Y_2)$ is less than the ratio between pressure and expelled volume as determined by the size $l_1$, plate thickness $t_1$, and Young's modulus $Y_1$ of the first vibrating plates 56 (ratio of expelled volume per unit of pressure) $K_1=f(l_1, t_1, Y_1)$ for normal discharge ($K_1>K_2$), whereby the amount of ink discharged can be reduced with a greater impact force, and the amount of ink needlessly consumed can therefore be reduced.

Assuming that a simple disc model is used when the vibrating plates are disc-shaped, and that the size of the vibrating plates (the radius of the disc-shaped vibrating plate) is L, the thickness of the vibrating plates is t, and the Young's modulus is $Y_1$ then the expelled volume K=f(L, t, Y) per unit of pressure as determined by the size L, the thickness t, and Young's modulus Y of the vibrating plates is expressed in the following formula (1) by a derivation of material mechanics, where the Poisson ratio is υ:

$$K=\pi\cdot(1-\upsilon)\cdot\{(7+\upsilon)\cdot L^6\}/\{16\cdot Y\cdot t^3\}. \quad (1)$$

Achieving the relationship $K_1>K_2$ as described above with two vibrating plates results in the conditions determined by the following formula (2), assuming the same material and thickness, for example:

$$L_1>L_2. \quad (2)$$

The conditions determined by the following formula (3) are obtained if solely the material is the same:

$$(L_1^2/t_1)>(L_2^2/t_2). \quad (3)$$

To achieve the formula (2) above, for example, the size of the second vibrating plates should be less than the size of the first vibrating plates. Also, if the thickness of the second vibrating plates can be increased, it is possible to further reduce the value $K_2$ of the second vibrating plates with the formula (3) above.

Figure 7:
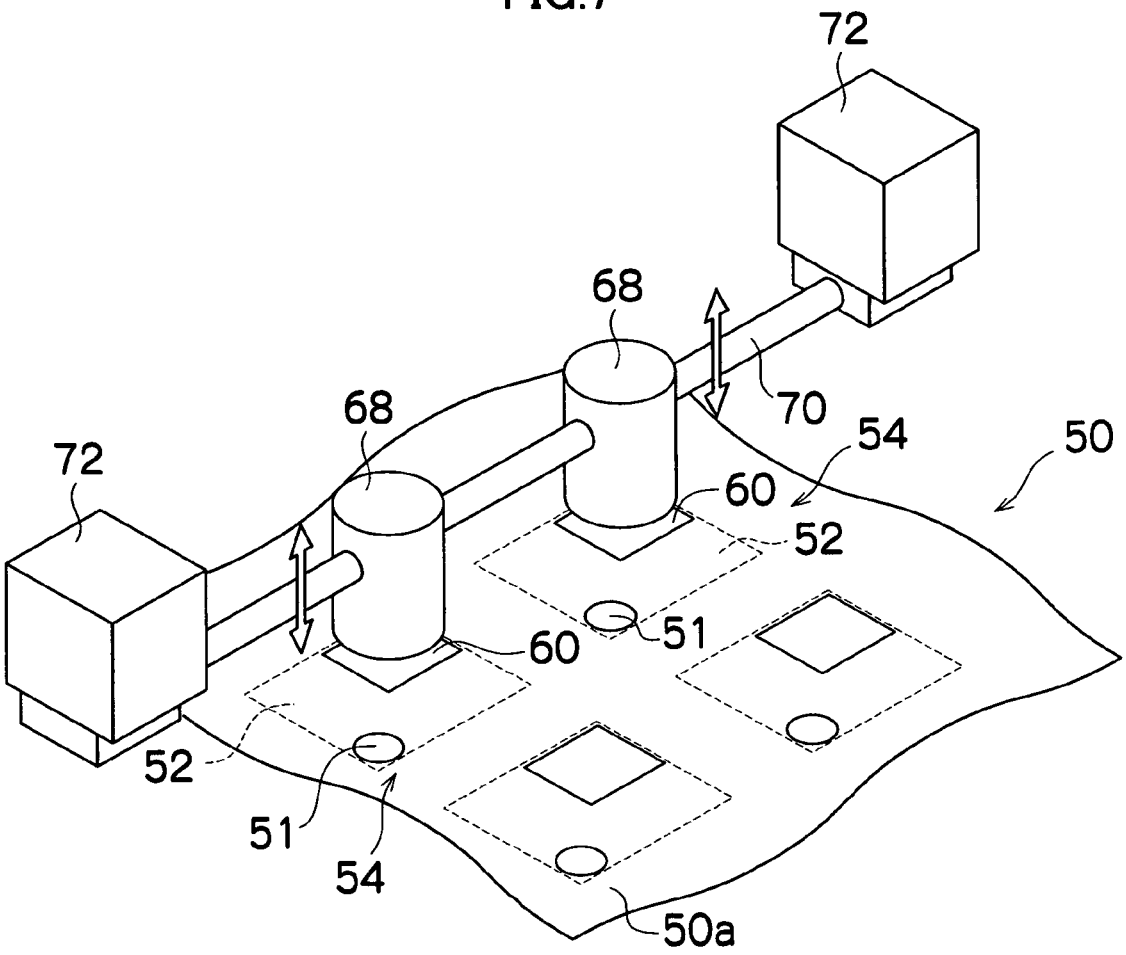
FIG. 7 is a perspective view showing the schematics of another example of the print head of the present embodiment.

FIG. 7 shows another example of an impact-transmitting member (second actuator). In the example shown in FIG. 7, the second vibrating plates 60 are struck with mallets.

More specifically, as shown in FIG. 7, pillar-shaped mallets 68 for striking the second vibrating plates 60 of the pressure chambers 52 are disposed above the second vibrating plates 60. The mallets 68 are set and fixed in place on a supporting shaft 70, and the supporting shaft 70 is driven up and down as shown by the arrows in FIG. 7 by solenoids 72 provided to both sides, whereby the mallets 68 strike the second vibrating plates 60 to apply an impact force.

The supporting shaft 70 is electromagnetically reciprocated by the solenoids 72 at both ends and is also moved parallel to the nozzle surface 50*a* of the print head 50, whereby the restoring operation can be performed for all the pressure chambers 52 aligned in a two-dimensional fashion.

Also, in the example described above, all of the second vibrating plates 60 are formed on the surfaces of the pressure chambers 52 opposite from the first vibrating plates 56, but the set positions of the second vibrating plates 60 are not limited thereto.

Figure 8:
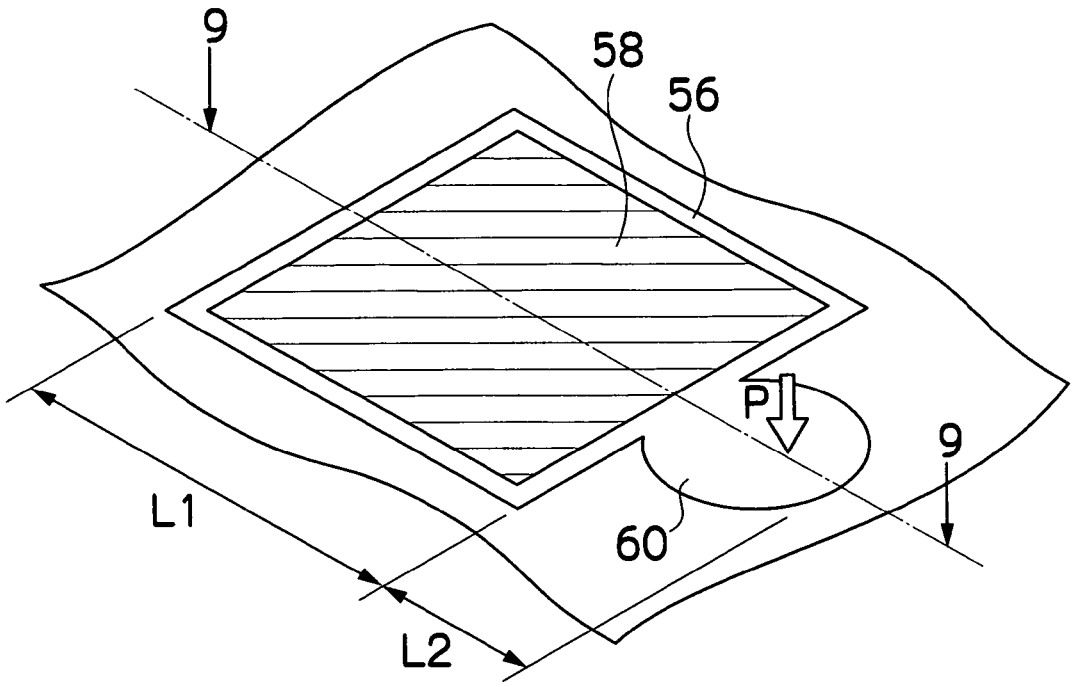
FIG. 8 is an explanatory diagram showing another example of the second vibrating plate of the present embodiment.

For example, as shown in FIG. 8, the second vibrating plate 60 may be formed on the same side as the first vibrating plate 56 as a continuation of the first vibrating plate 56 with a different shape. In this case, as shown in FIG. 8, the second vibrating plate 60 is made of the same material as the first vibrating plate 56 and is formed as one linked plate, but the shape is different from the first vibrating plate 56, and the second vibrating plate 60 is formed to be smaller. For example, the dimension L1 shown in FIG. 8 is smaller than the dimension L2.

Thus, the second vibrating plate 60 can be made to have a higher rigidity than the first vibrating plate 56 by giving the second vibrating plate 60 a different shape than the first vibrating plate 56. Also, the first vibrating plate 56 is subjected to pressure by the piezoelectric element 58, but the second vibrating plate 60 is subjected to impact by the second actuator (impact-transmitting member) previously described, as shown by the arrow P in FIG. 8.

Figure 9:
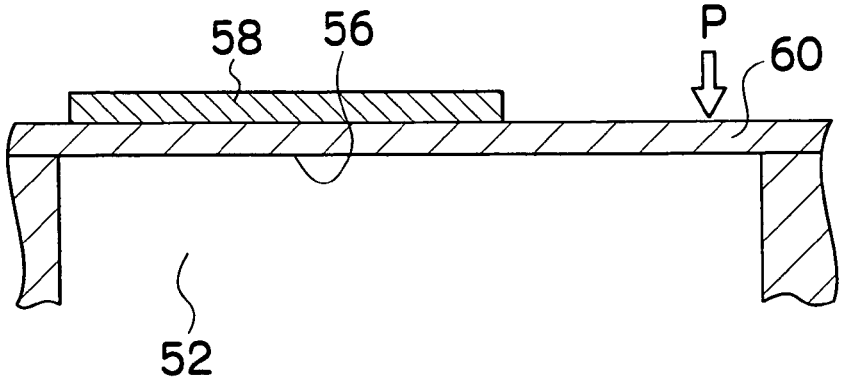
FIG. 9 is a cross-sectional view along the line 9-9 in FIG. 8.

A cross-sectional view along the line 9-9 in FIG. 8 is shown in FIG. 9. In the example shown in FIG. 9, the first vibrating plate 56 and the second vibrating plate 60 have approximately the same thickness, but this thickness may be different between the portion with the first vibrating plate 56 and the portion with the second vibrating plate 60 so as to provide the second vibrating plate 60 with a greater rigidity. Another method of providing the second vibrating plate 60 with greater rigidity would be to increase the Young's modulus of the second vibrating plate 60 to be greater than that of the first vibrating plate 56 when the thicknesses are the same.

In the example described above, scanning in a direction that intersect the shaft (the rotating shaft 62 or the supporting shaft 70) may be performed by moving the purging unit configured from these impact-transmitting members (the rotating shaft 62 on which the eccentric cams 64 are set, or the supporting shaft 70 on which the mallets 68 are set) parallel to the nozzle surface 50*a*, or the print head 50 may be moved instead.

Therefore, such a purging mechanism may be disposed at the bottom of the paper feed channel and configured so as to operate by rising and falling, or it may also be installed in the maintenance/retracting mechanism at a position separated from the paper feed unit.

Thus, according to the present embodiment, a highly rigid second vibrating plate is provided near the ink supply port in the pressure chamber separately from the first vibrating plate designed for normal discharge and provided with a piezoelectric element (first actuator) in the pressure chamber, the second vibrating plate is struck with a strong external force, and ink is forcefully discharged. Therefore, thickened ink or ink containing air bubbles or impurities in an area that extends from the ink supply port in the pressure chamber to the nozzle can be expelled all at once from the nozzle side, and maintenance can be effectively performed.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording head, comprising:

a first vibrating plate which forms part of a pressure chamber connecting an ink supply port and an ink ejection port;

a first actuator which induces ink ejection from the ink ejection port for printing by deforming the first vibrating plate;

a second vibrating plate which forms part of the pressure chamber; and a second actuator which induces ink ejection from the ink ejection port for performing maintenance by deforming the second vibrating plate, wherein a relationship K1>K2 is established between a ratio K1 of a volume of ink expelled by deformation of the first vibrating plate in relation to a pressure applied to the first vibrating plate by the first actuator during the ink ejection for printing, and a ratio K2 of a volume of ink expelled by deformation of the second vibrating plate in relation to a pressure applied to the second vibrating plate by the second actuator during the ink ejection for maintenance.

2. The inkjet recording head as defined in claim 1, wherein in presence of a plurality of the pressure chambers, a plurality of the second actuators which deform a plurality of the second vibrating plates provided to the plurality of the pressure chambers are driven by a single actuator drive source.

3. The inkjet recording head as defined in claim 1, wherein:

the second actuator has a separate structure from the second vibrating plate; and the second actuator is capable of being retracted from the second vibrating plate when the second actuator is not being driven.

4. The inkjet recording head as defined in claim 1, wherein the second vibrating plate is disposed near the ink supply port.

5. An inkjet recording apparatus, comprising the inkjet recording head as defined in claim 1.

6. The inkjet recording head as defined in claim 1, wherein the pressure applied to the second vibrating plate when the second vibrating plate is deformed is an impact force applied by the second actuator.

7. The inkjet recording head as defined in claim 1, wherein the pressure chamber has a planar shape of a quadrilateral, and is connected to the ink supply port and the ink ejection port respectively at opposite corners of the planar shape of the quadrilateral; and the second vibrating plate forms the part of the pressure chamber on a side connected to the ink supply port.

8. The inkjet recording head as defined in claim 1, wherein the second actuator is an eccentric cam formed with a rotating shaft in such a manner that the eccentric cam applies an impact force to the second vibrating plate when the rotating shaft rotates.

9. The inkjet recording head as defined in claim 1, wherein the second actuator is a mallet which is formed above the second vibrating plate and is driven up and down to apply an impact force to the second vibrating plate.

10. The inkjet recording head as defined in claim 1, wherein the second vibrating plate has higher rigidity than the first vibrating plate.

* * * * *